United States Patent [19]

Bradley

[11] 4,132,234

[45] Jan. 2, 1979

[54] METHOD AND APPARATUS FOR PRODUCING EXTENDED-LENGTH FINGERNAILS

[76] Inventor: Marianne Bradley, 1136 S. Shenandoah, Los Angeles, Calif. 90035

[21] Appl. No.: 763,727

[22] Filed: Jan. 31, 1977

[51] Int. Cl.[2] ..... A45D 29/00

[52] U.S. Cl. ..... 132/73

[58] Field of Search ..... 132/73, 75; 128/77, 128/157; 15/104; 350/315; 34/202

[56] References Cited

U.S. PATENT DOCUMENTS

| | | | |
|---|---|---|---|
| D. 142,327 | 8/1945 | McPharlin | 132/73 UX |
| D. 146,887 | 6/1947 | Wheeler | 132/73 UX |
| 2,169,990 | 8/1939 | Preve | 132/73 |
| 2,291,125 | 7/1942 | Wilkinson | 132/73 |
| 3,478,756 | 11/1969 | Sautter et al. | 132/73 |

*Primary Examiner*—G.E. McNeill

*Attorney, Agent, or Firm*—Fulwider, Patton, Rieber, Lee & Utecht

[57] ABSTRACT

Apparatus, and a related method for its use, for producing extended-length fingernails, the apparatus including a finger-supporting block having a groove therein to accommodate the finger, and at least one removable and reuseable form shaped to engage the end of the groove and to provide a firm supporting undersurface for the application of nail-extending material. Multiple removable forms are used to accommodate nails and fingers of various shapes and sizes.

6 Claims, 3 Drawing Figures

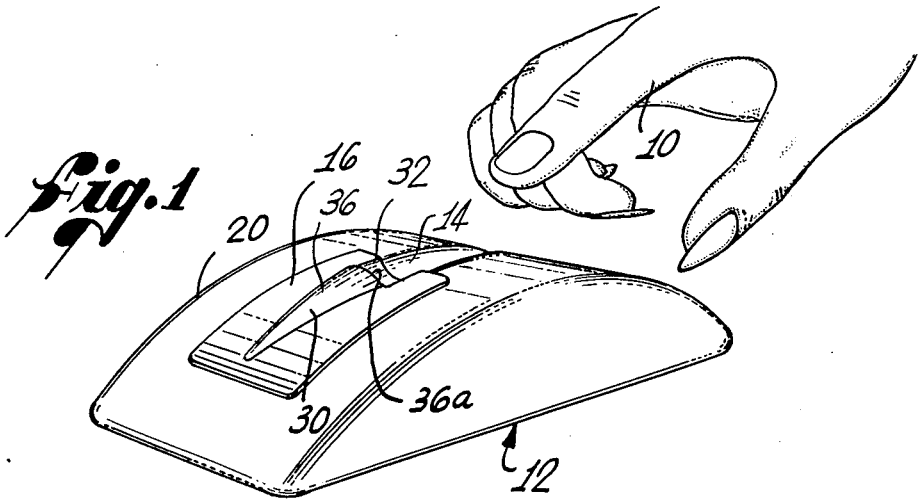
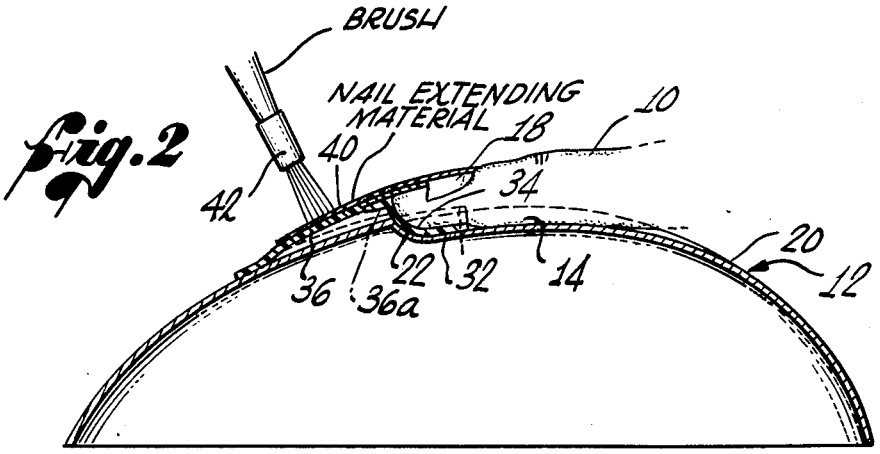
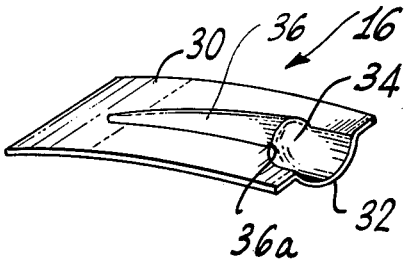
Fig. 3

METHOD AND APPARATUS FOR PRODUCING EXTENDED-LENGTH FINGERNAILS

BACKGROUND OF THE INVENTION

The present invention relates generally to artificial fingernails, and, more particularly, to an improved technique for extending the length of fingernails.

The most widely used method for extending the length of fingernails involves the use of a material which is widely known to manicurists as "porcelain." The material is usually supplied in the form of a liquid component and a powder component. The two components are mixed to form a paste-like material which is applied with a brush or applicator to the end of the fingernail to be extended. The paste-like material is applied until an extended-length fingernail of appropriate length and shape is obtained, and is then allowed to set, typically in two to five minutes. Then the nail is finished by filing until a satisfactory appearance is obtained.

The usual technique for confining the material, in its paste-like form as applied to the nail, is to utilize a metal-foil form which is affixed to the end of the finger. The form has a cut-out at one end, and is shaped to be placed under the natural fingernail. The form also has an adhesive on one side, to affix it to the skin. In using the form, the manicurist takes the hand of the person whose nails are to be extended, and may have to provide additional support for the metal-foil form while the "porcelain" material is being applied. The principal problem with this technique is that the form is much too pliable to provide a firm support for application of the porcelain material. Furthermore, the material tends to run underneath the natural nail, between the nail and the form, and then hardens in this configuration, requiring considerable filing and shaping after the form is removed. In fact, it is the finishing process that takes most of the manicurist's time in producing the extended-length nails. Other disadvantages are that the form often tears, and it sometimes adheres to the porcelain material.

Some improvement over the aforedescribed basic technique is suggested in a patent issued in the name of Slack, U.S. Pat. No. 2,799,282. The Slack patent discloses a finger support having flexible sides to accommodate a finger of practically any size, and a replaceable supportive form which fits inside the finger support. Although this device as briefly described in the Slack patent would probably alleviate some of the aforementioned problems, it is nevertheless a hand-held device, which suffers from many of the same disadvantages as the widely used prior art method. Accordingly, there is still a real need for improvement in this area, and the present invention is directed to this end.

SUMMARY OF THE INVENTION

The present invention resides in an improved technique for artifically extending the length of fingernails, wherein the nail is firmly supported to provide a relatively rigid undersurface on which to form the nail, and to practically eliminate the possibility of any nail-extending material running underneath the natural nail. Use of the invention drastically reduces the time required to file and finish the extended nail.

Basically, the apparatus of the invention includes a finger-supporting block shaped to receive a finger and to support it in a relatively stable position, at least one removable form having a portion shaped to fit under the fingernail when the finger is resting on the block and to provide a rigid undersurface for the application of nail-extending material, and means for positively locating the form with respect to the block.

More specifically, the block has an upper surface with a rounded groove therein to receive and support the finger. The groove terminates at one end in a rounded shoulder, and the removable form, which may be reused, has a curved flanged portion shaped to fit against the convex surface of the block, a first integral portion shaped to fit snugly in the groove and abutting the rounded shoulder, and a second integral portion raised above the flanged portion to provide an undersurface for the nail extension.

The finger is placed in the groove with the nail overlying the raised second integral portion of the form, and the nail-extending material may then be conveniently applied, with little likelihood of its running under the nail. The removable and reuseable forms may be conveniently molded from any of a variety of suitable plastic materials, the only requirement being that there should be little or no adhesion between the form and the nail-extending material. Since the form is reuseable, the recurring costs of disposable forms are eliminated, as well as the problems associated with the use of relatively flexible forms. Moreover, use of the invention requires less nail-extending material than did the old technique, since there is less wastage. Additionally, the process takes less time, and the resulting nail looks more natural, with less subsequent filing and shaping being required.

It will by now be apparent that the method of the invention comprises the steps of placing a reuseable form in the groove of the finger-supporting block, placing a finger of which the nail is to be extended in the groove so as to overlie a portion of the reuseable form, applying the material to extend the nail over the form, and then finishing the extended-length nail after removal from the form and the grooe. Since fingers and nails have different sizes and shapes, a number of different sized and shaped removable forms may be used with the same finger-supporting block.

It will be apparent from the foregoing that the present invention represents a significant advance in the production of artifical nails. In particular, it provides a novel technique for supporting the finger and the nail more securely. Use of the invention results in less wastage of material, a shorter time for production of the nails, and a more natural looking extended-length nail. Other aspects and advantages of the invention will become apparent from the following more detailed description, taken in conjunction with the accompanying drawings.

BRIEF DESCRIPTION OF THE DRAWINGS

FIG. 1 is a perspective view of the apparatus of the invention;

FIG. 2 is an enlarged elevational view, partly in section, of the invention apparatus in use; and FIG. 3 is a further enlarged perspective view of a removable form comprising one portion of the apparatus.

DETAILED DESCRIPTION

As shown in the drawings for purposes of illustration, the present invention relates to a technique for producing extended-length fingernails. As mentioned briefly above, the most widely used method for producing extended-length fingernails is by applying a material known to manicurists as "porcelain," which sets into a hard material similar in texture and appearance to the natural nail. The porcelain material is usually supplied in the form of a powder component and a liquid component, which are mixed together to form a paste-like material for application to the nail. The material sets hard within a few minutes after application. Prior to this invention, the paste-like material applied to the nail had to be supported by a relatively pliable metal-foil form affixed to the end of the finger, resulting in much wastage of the material and usually requiring considerable filing and finishing work on the nail after removal of the form.

In accordance with the present invention, the finger to which the nail-extending material is to be applied, indicated by reference numeral 10 in the drawings, is firmly supported on a block 12, having a groove 14 formed thereon, and a reuseable form 16 is engageable in the groove and provides a relatively rigid undersurface for the nail extension. This arrangement avoids having the material run under the nail 18, and reduces the nail-finishing time substantially. As best shown in FIG. 1, the apparatus of the invention includes the finger-supporting block 12, which may be of any convenient material, and which may be either hollow, as illustrated, or a solid block. The principal requirement for the block 12 is that it should have a generally convex upper surface 20 upon which the finger 10 may be rested. The block 12 shown by way of example has a generally rectangular base, and its upper surface 20 is convex as viewed in side elevation and is relatively flat as viewed in front or rear elevation. Formed in the upper surface 20, and extending in a front-to-rear direction, is the groove 14, which is of approximately semicircular cross section, and has a depth which is tapered from zero at one end of the approximate thickness of a finger at the other end. This latter, deep end of the groove terminates in a concavely rounded shoulder 22. The groove 14 is generally shaped and sized to accommodate a finger of average size.

The other principal element of the invention is the replaceable and reuseable form 16, which is designed to fit in the groove 14 of the block 10. The form 16 is of one-piece construction and comprises a generally rectangular flanged portion 30, which is shaped to conform with the convex upper surface 20 of the block 12. Depending from the flanged portion 30 is a relatively short-length rounded portion 32 sized to engage the rounded cross section of the groove 14. This depending portion 32 merges into a rounded shoulder 34, corresponding in shape to the shoulder 22 at the end of the groove 14, the shoulder 34 then merging into a raised upper portion 36 of the form, which in part defines a ledge **36*a* on which the nail 18 to be extended is positioned. The rounded shoulder 34 of the form 16 is the portion of the form in which the very tip of the finger 10 is placed, with the nail 18 overlying the ledge 36*a* of the raised portion 36. The raised portion 36 is convex as viewed in elevation, from the front of the block 14, and is of such a width as to accommodate a fingernail of a particular size range. The width of the raised portion 36 and its height above the flanged portion 30 are both gradually tapered to smaller dimensions towards the front of the block 14, i.e. towards the end of the form remote from the end in which the finger 10 is placed. Although only one form 16 is illustrated, it will be understood that a number of forms designed to accommodate different sizes and shapes of fingers will be available for use with a single block. These forms of different sizes will vary principally in the size and shape of the raised portion 36** of the form, which will be of various widths, heights and cross-sectional shapes.

The material used for the form 16 may be any of a variety of materials, preferably molded plastics. The forms will be flexible but relatively stiff, to provide adequate support for the fingernails to be extended. Although the flanged portion may be thin enough to be flexed by finger pressure, the shoulder portion 34 and raised portion 36 will, because of their shape, possess considerable inherent rigidity, even though of much the same thickness as the flanged portion 30.

In practicing the method of the present invention, a form 16 is selected appropriate to the size of the finger 10 first to be operated on by the method, and the form is placed in the groove 14 of the block 12. Then the finger 10 is placed in the groove 14, with the end of the finger overlying the depending portion 32 of the form 16 and with the fingernail 18 overlying and snugly engaging the ledge **36*a* of the raised portion 36 of the form. Nail-extending material 40 is then applied over the end of the nail 18 and the raised portion of the form 16, using a brush 42 or some other type of applicator. The raised portion 36 of the form 16 provides a firm and properly-shaped under-surface for the application of the nail-extending material 40, and practically eliminates the time-consuming finishing work which would otherwise be necessitated by use of a more flexible form. When the nail 18 has been extended to a sufficient and desired length, the finger 10 is removed from the block 12 and from the form 16**, and any finishing and filing is attended to; then the process is repeated for the other fingers.

It will be apparent from the foregoing description that the present invention constitutes a significant advance in the care and treatment of fingernails, since it reduces both the time and the cost required for producing extended-length fingernails, and produces a finished nail of superior quality to that which was previously obtainable. It will also be appreciated that, although a specific embodiment of the invention has been described in detail for purposes of illustration, various changes may be made without departing from the spirit and scope of the invention. Accordingly, the invention is not to be limited except as by the appended claims.

I claim:

1. Apparatus for producing extended-length fingernails, comprising:

a finger supporting block locatable on a firm work surface and shaped to receive a finger and retain it in a relatively stable position;

at least one removable form having a rigid convex surface closely corresponding to the contours of a relatively long fingernail, said convex surface having a curvilinear ledge shaped to fit under the fingernail when the finger is resting on said block and providing a rigid under-surface for the application of nail-extending material; and means for positively locating said form on said block.

2. Apparatus as set forth in claim 1, wherein said means for positively locating said form on said block includes means integral with said form engageable with means integral with said block.

3. Apparatus for producing extended-length fingernails, comprising:

a shaped support block locatable on a firm work surface, for supporting a finger of which the nail is to be extended, said block having an upper surface with a rounded groove therein to receive and support the finger, said groove terminating at one end in a shoulder; and at least one removable form having an outer flanged portion shaped to fit against said upper surface of said block, a first integral portion depending from said flanged portion and shaped to fit snugly in said groove abutting said shoulder, and a second integral portion raised above said flanged portion to provide a firm undersurface for the nail extension, said second integral portion including a rigid convex surface closely corresponding to the contours of a relatively long fingernail and having a curvilinear ledge shaped to fit under the natural fingernail when the finger is resting on said support block;

whereby the finger is placed in said groove with the natural nail partially overlying said convex surface of said second integral portion, to allow nail-extending material to be efficiently applied over said convex surface in such a manner as to minimize final shaping and filing work on the nail.

4. Apparatus as set forth in claim 3, wherein there are plurality of forms, each differently proportioned to accommodate a particular shape and size of finger and nail.

5. A method for producing extended-length fingernails, comprising:

selecting a reuseable form of size appropriate to supply an undersurface for application of nail-extending material to a particular finger;

placing the form in a groove formed in a shaped block on which the finger is to be rested;

placing the finger in the groove with the fingertip in the form and the nail partly overlying a nail-shaped convex surface on the form, whereby the nail-shaped surface of the form provides a firm undersurface to support the nail-extending material;

applying the nail-extending material to the nail over the form;

removing the finger from the form and the groove; and finishing the nail as desired.

6. A method as set forth in claim 5, and further including the steps of:

replacing the form with another of shape and size selected to accommodate a different finger and nail; and repeating the foregoing steps on other fingers of which the nails are to be extended.

* * * * *